US005303124A

United States Patent [19]

Wrobel

[11] Patent Number: 5,303,124

[45] Date of Patent: Apr. 12, 1994

[54] SELF-ENERGIZING LED LAMP

[76] Inventor: Avi Wrobel, 445 S. Douglas St., El Segundo, Calif. 90245

[21] Appl. No.: 95,301

[22] Filed: Jul. 21, 1993

[51] Int. Cl.[5] ..... F21V 19/04

[52] U.S. Cl. ..... 362/20; 362/249; 362/800; 362/812; 40/570

[58] Field of Search ..... 362/20, 157, 227, 249, 362/800, 812; 439/611, 613, 615; 40/550, 564, 570, 572

[56] References Cited

U.S. PATENT DOCUMENTS

| | | | |
|---|---|---|---|
| 2,213,584 | 9/1940 | Hulst | 362/20 |
| 4,435,743 | 3/1984 | Plumly | 362/20 |
| 4,587,597 | 5/1986 | Meyers | 40/570 |
| 4,812,827 | 3/1989 | Scripps . | |
| 4,903,172 | 2/1990 | Schoniger et al. . | |
| 4,918,357 | 4/1990 | Waterbury | |
| 4,931,780 | 6/1990 | LaMont et al. . | |
| 4,953,067 | 8/1990 | Moore . | |
| 4,965,457 | 10/1990 | Wrobel et al. . | |
| 4,967,317 | 10/1990 | Plumly | 40/550 |
| 5,018,290 | 5/1991 | Kozek et al. . | |
| 5,036,248 | 7/1991 | McEwan . | |
| 5,151,679 | 9/1992 | Dimmick . | |
| 5,160,201 | 11/1992 | Wrobel et al. . | |

*Primary Examiner*—Richard R. Cole
*Attorney, Agent, or Firm*—Denton L. Anderson

[57] ABSTRACT

An illuminating module with battery backup consisting of an array of light-emitting diodes is provided wherein the module combines the battery backup with the LED array in a self-contained light bulb-like unit which can be retrofitted into an existing incandescent light bulb socket. The batteries and the LED array are attached to a planar baseboard which further includes two base connectors. The base connectors are adapted to fit into existing light bulb sockets and are rotatably mounted on an edge of the baseboard to enable screwing them into light bulb sockets while the baseboard is kept stationary. The backup batteries are recharged from an external source of electrical current flowing through the base connectors. An automatic switching device switches the supply of electrical power for the LED array from the external source of electrical power to the backup batteries, when the flow of external electrical power is disrupted. A circuit causes the LED array to flash on and off to indicate interruption of external power, to prolong battery life, and to make the module more conspicuous in emergency conditions.

17 Claims, 3 Drawing Sheets

FIG. 1
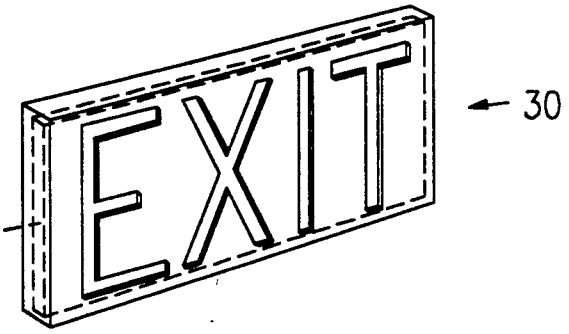
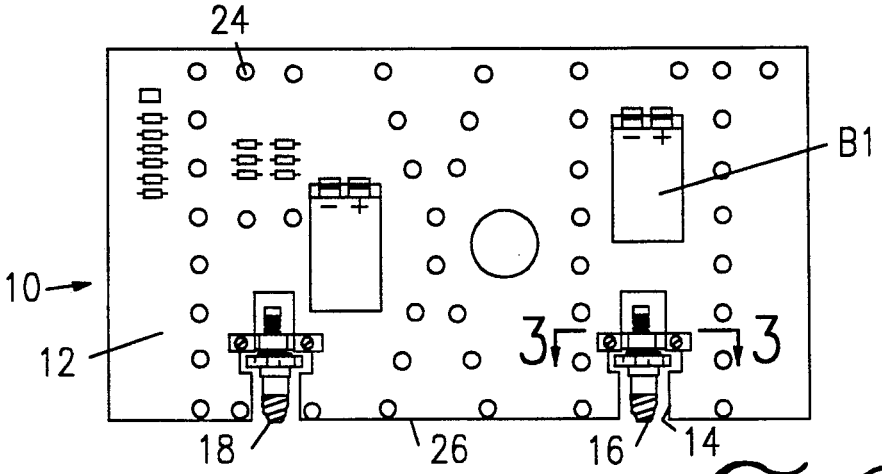
FIG. 2
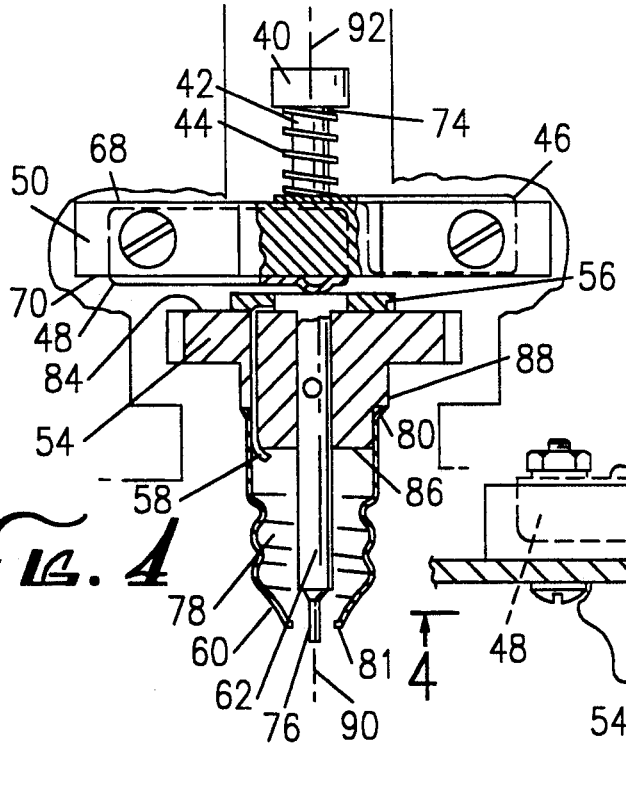
FIG. 4
FIG. 3
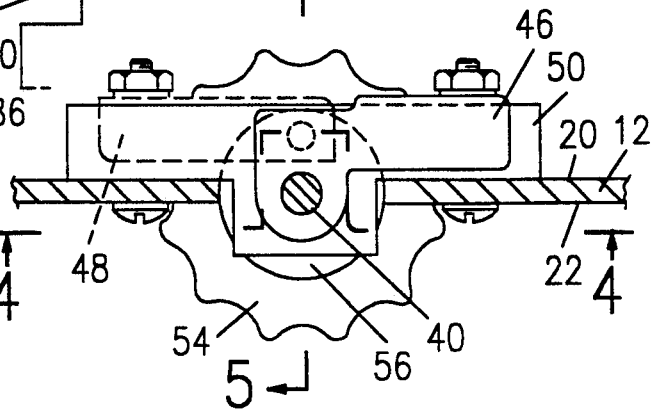

SELF-ENERGIZING LED LAMP

BACKGROUND

This invention relates generally to devices useful for illuminating display units, and specifically to illuminated display units which can be retrofitted into existing incandescent light bulb sockets.

Most public buildings now require perpetually lighted exit signs to direct people out of the buildings in case of an emergency. Usually such exit signs are powered by the normal building electrical power supply.

Problems arise, however, when the nature of the emergency causes the building power supply to go out. This shuts down the exit signs, defeating their purpose.

In an attempt to get around this problem, many building codes are now requiring that the exit signs have an independent, back-up power supply. The theory is that, if the main power supply goes out, the back-up power supply will continue to maintain the signs in a lighted state. However, most prior back-up power supply systems utilize a remote source of power, such as a generator. Because such power back-up source is remote, long runs of electrical wiring must often be used to connect the back-up remote source to the individual exit signs. Such wiring can be damaged during a fire or other catastrophic disaster.

Some installations use battery packs as the backup system for emergency signs. Each sign has its own battery pack located somewhere in the vicinity of the illuminating units. However, this is not entirely satisfactory either. Such battery packs still require some amount of external wiring to electrically connect the battery pack to the signs. Such wiring is damageable and requires labor and time for installation. Moreover, battery packs must generally be monitored closely to make sure the batteries never run down. Also, battery packs are bulky and difficult to hide in a way where they can be easily maintained and where the batteries can be periodically replaced.

These problems with prior art back-up devices become even more acute where an existing sign must be upgraded to include an independent back-up power supply. Utilizing a remote source of electrical power is even less satisfactory than in new installations since, in addition to the disadvantages mentioned above, installation requires extensive rewiring of the entire building. Utilizing individual battery packs is also less satisfactory because hiding the bulky, unsightly battery packs generally requires substantial remodeling efforts.

Accordingly, there is a pressing need for a system which will provide emergency back-up power to exit signs and other emergency signs which does not rely on a remote power source or extra wiring. Such a system should not require the "hiding" of a battery pack unit. Such a system should be able to utilize small and manageable battery packs. Such a system should not require the continued monitoring and frequent replacement of the batteries. Such a system should be easy to maintain. There is also a need for such a system which is easily and inexpensively "retrofittable" into existing exit signs.

SUMMARY OF THE INVENTION

The invention satisfies these needs.

The invention provides an illuminating module which can be retrofitted into an existing incandescent light bulb socket having a female connector socket which is energized by an external source of electrical power. The illuminating module comprises a planar baseboard having an upper surface and a parallel lower surface. A plurality of light emitting electrical units are affixed to the upper baseboard surface, or to both upper and lower baseboard surfaces, and electrically interconnected in a desired pattern to form an array with opposite electrical poles.

The module further comprises an electrically conductive cylindrical base connector adapted to connect to the female connector socket. The base connector has oppositely charged electrical poles and is affixed to the baseboard such that the base connector is rotatable about its longitudinal axis while the baseboard is kept stationary. The array is electrically connected with the oppositely charged poles of the female connector, through the base connector, to form a closed circuit.

Batteries are affixed to the baseboard for supplying electrical power to the array when the flow of external electrical power to the female connector is disrupted. The batteries are recharged through a recharging device powered by the external source of electrical power. An automatic switching device switches the supply of electrical power for the array from the external source of electrical power to the batteries, when the flow of external electrical power is disrupted.

In a preferred embodiment of the invention a circuit causes the light-emitting electrical units to flash on and off when the flow of external source of electrical power is interrupted. Such flashing serves to warn that the external power flow has been interrupted and calls greater attention to the module during an emergency. The flashing also prolongs the life of the backup batteries.

In another preferred embodiment the light-emitting electrical units are light-emitting diodes. Two base connectors are affixed to an edge of the baseboard with their longitudinal axes in parallel to each other and in the plane of the baseboard, with the base connectors spaced apart sufficient to connect into existing female connector sockets.

In the embodiment discussed in the immediately preceding paragraph, two T-shaped mounting members with upper and lower surfaces and transversely disposed across notches defined in the baseboard, and the base connectors are rotatably mounted on the T-shaped member. One or both of the T-Shaped members can further comprise electrically conductive strip conductors affixed to its upper and lower surfaces. The upper strip conductor is electrically connected at its one end to a first of the two array electrical poles and at its other end in electrical contact with a first of the two base connector electrical poles. The lower strip conductor is electrically connected at its one end to the second of the two array electrical poles and at its other end in electrical contact with a second of the two connector base electrical poles.

The invention provides the ability to illuminate displays, such as an emergency EXIT sign, with an array of durable, low maintenance LED units, with self-contained battery backup, all easily retrofittable into an existing incandescent light bulb socket. The prior art problems stemming from using a remote source of back-up power, or extra wiring, or using battery back-up requiring "hiding" of a battery pack, or incurring expenses in upgrading existing signs to include back-up systems, is overcome in the invention by providing a direct replacement lamp which combines a battery backup with illuminating modules in a self-contained light bulb-like unit which can be retrofitted into an existing incandescent light bulb socket.

DRAWINGS

These and other features, aspects and advantages of the present invention will become understood with reference to the following description, appended claims and accompanying drawings where:

FIG. 1 is a perspective view of an emergency EXIT sign enclosing an embodiment of an illuminating module having features of the invention;

FIG. 2 is a top view of the module;

FIG. 3 is a top view of a turn screw assembly along line 3—3;

FIG. 4 is a cross section of the turn screw assembly of FIG. 3 along line 4—4;

DESCRIPTION

Figure 5:
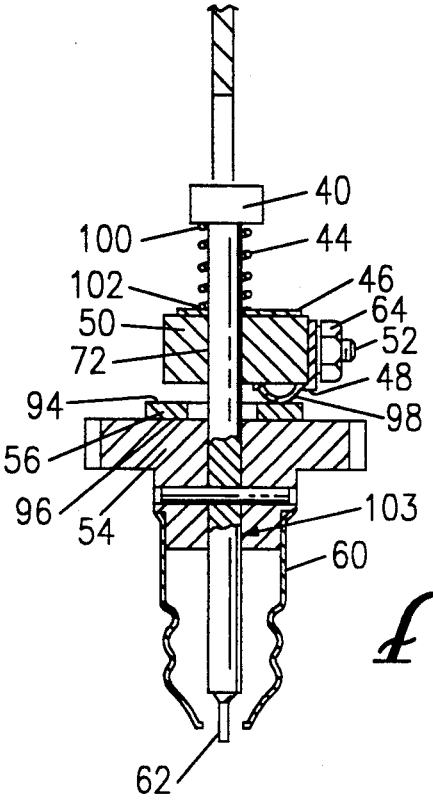
FIG. 5 is another cross section of the turn screw assembly of FIG. 3 along line 5—5.

The following discussion describes in detail several embodiments of the invention. This discussion should not be construed, however, as limiting the invention to those particular embodiments. Practitioners skilled in the art will recognize numerous other embodiments as well. For definition of the complete scope of the invention, the reader is directed to the appended claims.

Referring to the drawings, a panel illuminating module 10 embodying features of the invention is shown in FIG. 2. The module 10 is adapted for installation into an existing exit sign box 30 shown in FIG. 1.

The module 10 comprises a planar baseboard 12 having an upper baseboard surface 22 and a substantially parallel lower baseboard surface 20. The baseboard 12 defines notches 14 on its edge 26. The baseboard 12 is composed of an electrically insulating material such as wood, plastic, fiberglass, ceramic materials, etc. Preferably, for simplicity and efficiency of manufacture, the baseboard 12 is a standard printed circuitry board ("PC Board") comprising, for example, a fiberglass or ceramic planar substrate coated on its upper and lower surfaces with an electrically conducting material such as copper.

The baseboard 12 also comprises a plurality of light-emitting electrical units 24 affixed to the upper baseboard surface 20 (or to both upper and lower baseboard surfaces) in a pattern, for example: to form the word EXIT. The light-emitting electrical units 24 can be ordinary light bulbs. However, incandescent bulbs consume large amounts of electrical energy, particularly, when the building has hundreds of emergency signs. Also, powerful and expensive back-up batteries are required to sustain the incandescent bulbs for any reasonable amount of time in case of a power failure. Incandescent bulbs have relatively short life spans and are subject to premature failure due to vibrations and the like, requiring a considerable amount of maintenance to replace the bulbs.

Preferably, the light emitting-electrical units 24 are light-emitting diodes, since light-emitting diodes consume far less power than ordinary light bulbs. Also, light-emitting diodes have a much longer service life than do ordinary light bulbs and are quite impervious to environmental stress. The light emitting-diodes can be any standard light-emitting diodes known in the art. Similarly, light bulbs usable in the invention can be any of the standard miniature light bulbs available in the art.

Figure 6:
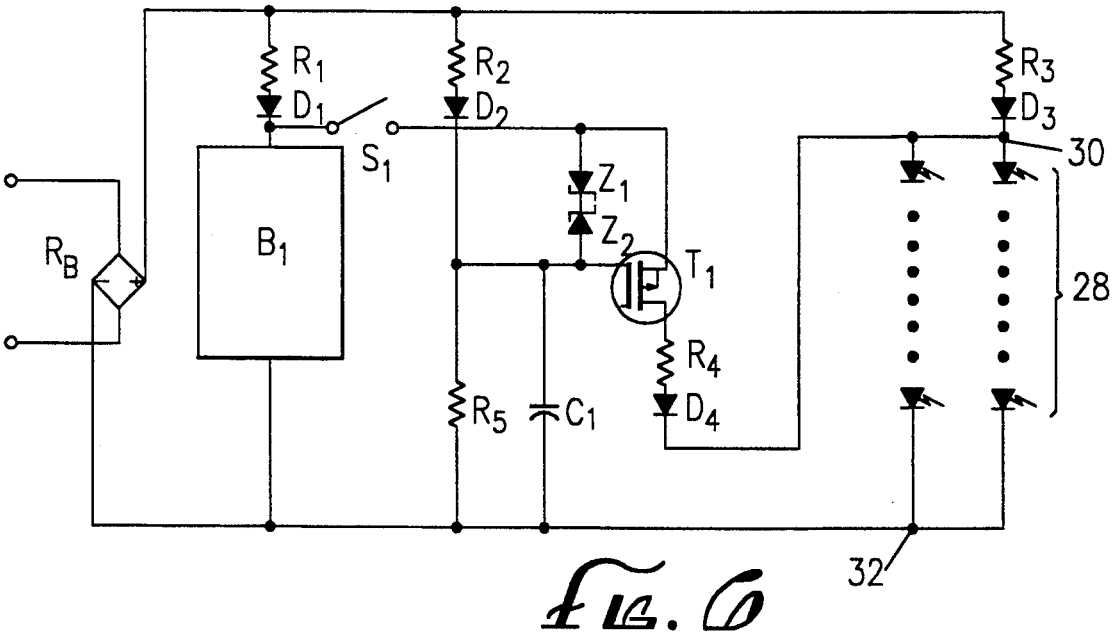
FIG. 6 is a schematic drawing showing electrical circuitry that may be used for the illuminating module shown in FIG. 2.

The light-emitting electrical units 24 are electrically interconnected by standard electrical circuitry means to form an array 28 of light-emitting electrical units 24, as shown in FIG. 6, having a single first electrical pole 30 and a single, oppositely charged second electrical pole 32.

The light-emitting electrical units 24 can be interconnected by any of the standard electrical circuitry methods known in the art. Wires, for example, can be used to interconnect the light-emitting electrical units 24.

The baseboard 12 also comprises turn screw assemblies 16 and 18 disposed within notches 14 defined in the baseboard 12. Different Cross sections of the turn screw assembly 16 are shown in FIGS. 2, 3, 4, and 5. In reference to these figures, the turn screw assembly 16 consists of a substantially T-shaped mounting member 50 with an upper member surface 68 and a lower member surface 70. The member 50 is transversely disposed across the notch 14 defined in the baseboard 12 and held in place by screws 52. The member 50 has an opening extending between the upper member surface 68 and the lower member surface 70.

The turn screw assembly 16 comprises an electrically conductive upper strip conductor 46 affixed to the upper member surface 70 by the mounting screw 52 and terminating proximate to the member opening 72.

The turn screw assembly 16 also comprises an electrically conductive lower strip conductor 58 affixed to the lower member surface 70 by the mounting screw 52, the lower strip conductor terminating proximate to the member opening 72.

A shaft 42 consisting of electrically conducting material is slidably and rotatably disposed within the member opening 72 at approximately right angles to the member upper surface 68 and the member lower surface 70. The diameter of the shaft 42 is generally slightly smaller than the diameter of the member opening 72 to allow the shaft 42 to slide within the member opening 72. The diameter of the shaft 42 is preferably not so much smaller than the diameter of the member opening 72, however, to allow excessive play between the shaft 42 and the mounting member 50.

The shaft 42 has an upper shaft end 74 and a lower shaft end 62. The upper shaft end 74 is adapted with a shaft head 40 which shaft head 40 has a diameter greater than that of the lower shaft end 62. The shaft head 40 can be of round cylindrical shape. The lower shaft end 62 is adapted with a downwardly directed electrical contact point 76 of standard shape and dimensions.

A cylindrical base connector 60 is disposed around the lower shaft end 62 above the downwardly directed electrical contact point 76. The cylindrical base connector 60 is made from an electrically conductive material such as a metal. The preferred material is brass. In the embodiments illustrated in the drawings, the base connector 60 is specially adapted for threaded projection into a female connector socket of a screw-in style with corresponding threads. In other embodiments, the cylindrical base connector 60 can be adapted to engage a standard bayonet or other conventional type of female connector socket. The diameter of the base connector 60 is larger than the diameter of the member opening 72.

The base connector 60 is electrically insulated from the shaft 42. This can be accomplished by interposing a sleeve 103 of a nonconductive material within the shaft 42 and the base connector 60. The base connector 60 has an upper base connector end 80 and a lower base connector end 82 and a longitudinal axis 90. The base connector 60 is affixed to the shaft 42 such that the longitudinal axis 90 of the base connector 60 is substantially coincident with the longitudinal axis 92 of the shaft 42.

A cylindrical thumb wheel 54 consisting of an electrically insulating material is fixedly attached around the shaft 42 above the base connector 60. Thumb wheel 54 has an upper wheel end 84 and lower wheel end 86 and longitudinal axis 90. The longitudinal axis 90 of the thumb wheel 54 is substantially coincident with the longitudinal axis 92 of the shaft 42. The lower wheel end 86 is smaller in diameter than the upper end so of the base connector 60 such that the lower wheel end 86 projects into the base connector 60 and snugly fits within the cylindrical walls of the base connector 60. The projection ends where the lower wheel end 86 meets the sleeve 103 proximate to the upper end 80 of the base connector 60. The diameter of the upper wheel end 84 of thumb wheel 54 is larger than the diameter of the member opening 72.

An electrically conductive contact plate 56 with an upper surface 94 and a lower surface 96 and a longitudinal axis 90 is fixedly attached around the shaft 42 above the thumb wheel 54. The longitudinal axis 90 of the contact plate 56 is substantially coincident with the longitudinal axis 92 of the shaft 42. The lower surface 96 of the contact plate 56 is adjacent to the upper end 84 of the thumb wheel 54. The upper surface 94 of the contact plate 54 is in electrical contact with the lower strip conductor 48. An electrically conductive wire 58 electrically connects contact plate 54 to the base connector 58.

Preferably, the contact plate 56 is cylindrical and is made out of brass. The diameter of the contact plate 56 is larger than the diameter of the member opening 72 to prevent the contact plate 56 from passing through the base member opening 72.

As so constructed, the smooth rotation of the thumb wheel 54 about its longitudinal axis 90 will cause an equivalent smooth rotation of the shaft 42, the contact plate 56, and the base connector 60 about the base connector's longitudinal axis 90.

A spring 44 is disposed around the upper shaft end 72, above the upper surface 68 of the member 50 and below the shaft head 40. The spring 44 can be a coiled, compressible spring. The spring 44 is composed of an electrically conductive material such as brass or other metal. The upper end 100 of the spring 44 has a diameter less than that of the shaft head 40 so that the spring 44 cannot slide over the shaft head 40. The lower end 102 of the spring 44 has a diameter larger than that of the member opening 72 so that the spring 44 cannot slide through the member opening 72. The spring 44 is slidably disposed about the shaft 42 such that the upper end 100 of the spring impinges against the shaft head 40 and the lower spring end 102 impinges upon the upper strip conductor 46. The spring 44 is sufficiently long so that when disposed about the shaft 42 it is in compression. In this way, the upper surface 94 of the contact plate 56 is urged into contact with the lower strip conductor 48.

The upper strip conductor 46 can be disposed proximate to the member opening 72 in any particular shape or pattern so long as suitable electrical contact is provided with the spring 44. Preferably, for maximum electrical contact, the end of the upper strip conductor 46 proximate to the member opening 72 has the shape of a concentric ring about the opening 72 of a diameter smaller than the diameter of the lower end 102 of the spring 44, but larger than the diameter of shaft 42.

Similarly, the shape of the lower strip conductor 48 proximate to the member opening 72 can be any particular shape or pattern so long as suitable electrical contact is made between the lower strip conductor 48 and the upper surface 94 of the contact plate 56. Preferably, for maximum electrical contact, the end of the lower strip connector 48 proximate to the member opening 72 has a downwardly projecting curvature to impinge upon the upper surface 94 of the contact 56.

The turn screw assembly 18 comprises all of the elements of the turn screw assembly 16 except for the contact plate 56 and the strip conductors 46 and 48. In all other aspects, the turn screw assembly 18 is identical to the turn screw assembly 16.

The module 10 further comprises back-up batteries B1 affixed to the baseboard 12. Preferably, the back-up batteries are recharged by the circuitry so that backup power is always available. Recharging also minimizes the cost and labor involved in frequent checking and replacing of the backup batteries.

FIG. 6 shows the circuitry for one embodiment of the invention without flashing LEDs. External AC voltage is applied to the nodes of the rectifier device RB converting AC current to DC current. The DC current flows from the positive pole of the rectifier device RB, through the resistor R3 and the diode D3 through the LED array 28, lighting the array, and to the negative pole of the rectifier device RB. DC current also flows through the resistor R1 and the diode D1 to the battery B1 keeping the battery charged.

The switching device T1 is a p-channel metal oxide semiconductor (PMOS). During normal operation, when the AC voltage is on, the gate of PMOS T1 is reverse biased and no current flows through the resistor R2>the diode D2>the gate of the PMOS T1>the source of the PMOS T1>the resistor R4>the diode D4>the pole 30 of the LED array 28.

Since diodes D1, D2, D3, and D4 have high reverse break down voltage, current cannot flow through them in the reverse direction. For example, the diode D1 prevents the battery B1 from discharging across the resistor R1 when the supply of AC power is disrupted.

When the AC power is cut off, the PMOS T1 begins conducting. Therefore, the current from the positive pole of the battery B1 flows through the PMOS T1>the resistor R4>the diode D4>the pole 30 of the LED array 28. This alternative source of power keeps the LED array 28 lighted during a power failure.

Figure 7:
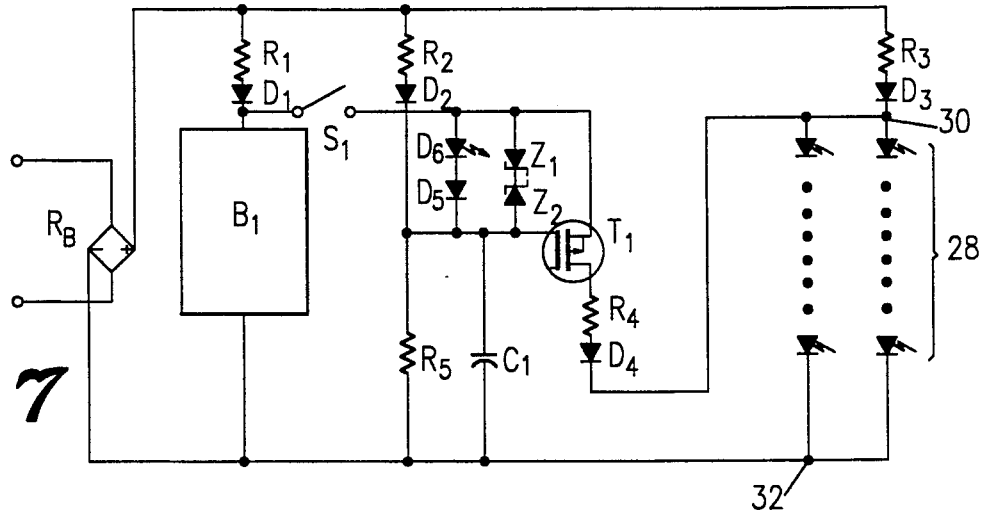
FIG. 7 is another schematic drawing showing the electrical circuitry that may be used for the illuminating module shown in FIG. 2.

FIG. 7 shows the circuitry for another embodiment of the invention with the flashing feature. The AC current is converted to DC current through the same means as in FIG. 6. The battery backup B1 is kept charged as in FIG. 6.

In the embodiments shown in FIGS. 6 and 7, if the battery enable switch S1 is open, the battery B1 is effectively disconnected from the LED array 28. In that case, no backup power is provided if the AC current is cut off. This would be the case before the module 10 is installed. In the following, it is assumed that the battery enable switch S1 is closed.

During normal operation, DC current flows from the positive pole of the device RB and powers the LED array 28 in the same manner as described for FIG. 6. Similarly, during this mode, the PMOS T1 is cut off. Also, since the diodes D1, D2, D3, and D4 have high reverse voltage breakdown, current cannot flow through them in the reverse direction.

When the supply of AC power is disrupted, the gate of T1 and the blinking LED D6 become forward biased. The LED D6 blinks on and off. When it is on, the gate of T1 is held below its threshold voltage for current conduction; when the LED D6 is off, the gate of T1 allows current flow from battery B1 to the LED array 28, causing the LED array 28 to flash. Although this effect is not required, it is a desirable feature during emergency situations, as it prolongs battery life, warns of disruption of primary power, and makes the module more conspicuous.

Those skilled in the art will recognize that any number of other circuitry schemes can also be used.

EXAMPLE

In an illustrative example embodiment of the invention, the baseboard is a standard PC Board made of copper-coated flame retardant fiberglass. Circuitry paths are made in the board with copper strips coated with tin/lead solder. The baseboard is rectangular, having a length of 11 inches and a width of 5.75 inches. In each of the turn screw assemblies, the cylindrical base connector is a T-4½ CANDELABRA screw base. The shaft is made of brass. Its overall length is 1.88 inches. The head portion of the shaft is 0.12 inches in length. The shaft has a nominal diameter of 0.125 inches. The head portion of the shaft has a diameter of 0.25 inches.

The spring is constructed of phosphor bronze. It is 0.5 inches long. It has an outside diameter of 0.16 inches. The spring has 7 coils and a closed end. It is constructed of wire, having a diameter of 0.030 inches. The thumb wheel is made out of nonconductive material. The outer diameter of the thumb wheel is 1.0 inches. The diameter of the inner concentric circular opening for passing the shaft through is 0.125 inches. The lower cylindrical extension of the thumb wheel is 0.281 inches long and has a diameter of 0.42 inches to fit into the cylindrical base connector which is 0.5 inches in diameter. There are 12 evenly spaced projections on the outer perimeter of the thumb wheel. The height of each projection is 0.04 inches.

The contact plate is made out of brass. Its outer diameter is 0.562 inches. The diameter of the inner concentric circular opening in the contact plate is 0.25 inches. The contact plate is 1/16 of an inch thick.

The T-shaped mounting member is ¼-inch thick flame retardant plastic or equivalent. The upper portion of the T is 1.625 inches long and 0.25 inches wide. The lower portion of the T is 0.5 inches long and 0.25 inches wide. The diameter of the member opening is 0.125 inches, and is centered 0.032 inches from the lower edge of the upper portion of the T and centered along its length.

The lower strip conductor has a base plate and an upwardly extending riser at right angles with the base plate. The strip conductor is made out of 0.013-inches thick spring tempered brass. The base plate is rectangular, 0.18 inches wide and 0.81 inches long. A downwardly projecting dimple in the plane of the base plate, is 0.125 inches in diameter and 0.04 inches in depth and is centered 0.093 inches from the base of the riser and 0.867 inches from a width of the base plate. The dimple provides electrical contact between the base plate and the contact plate. The upwardly extending riser is 0.81 inches long and 0.25 inches high. Contact to the baseboard is made through a mounting screw, which presses against a conductive trace.

The upper strip conductor consists of a base plate and an upwardly extending riser at right angles with the base plate. The base plate is L-shaped. It is 0.21 inches wide on the rise of the L and 0.88 inches long. The base of the L is approximately 0.42 inches long and 0.3 inches wide. The base of the L has a circular opening 0.128 inches in diameter centered 0.28 inches from the rise of the L and 0.15 inches from the lower edge of the base of the L. The riser portion of the strip is 0.5 inches long and 0.25 inches high.

The upper and lower strip conductors are mounted on the T-shaped mounting such that they are not in electrical contact with each other. Furthermore, the upper strip conductor is mounted on the upper portion of the supporting member such that the circular opening in the upper strip conductor is concentric with the circular opening in the supporting member.

It should be noted that in this embodiment only one of the turn screw assemblies requires the strip conductors as only one of the turn screw assemblies provides current from the external source of power. However, in other embodiments two or more turn screws can be used as conductors for circuit redundancy. The turn screw assemblies are mounted along one of the long edges of the baseboard, such that their longitudinal axes is 2.59 inches from the short edges of the baseboard respectively. The longitudinal axes of the turn screws are spaced 5.82 inches from each other.

Forty-eight LED units are used. Each of the LED units is a standard 0.200 diameter, T 1¾, midget light-emitting diode.

FIG. 7 shows the circuitry for the example embodiment with each of the circuit elements selected as designated and electrically connected in FIG. 7.

The battery pack consists of 7 rechargeable nickel-cadmium 9-volt batteries connected in series. The circuit of FIG. 8 causes the light-emitting diodes to flash when the flow of external power is disrupted. Of course, it is not necessary to include the flashing in every alternative embodiment of the invention. However, the flashing is an indicia of disruption of external power to the module and also prolongs battery life.

Figure 9:
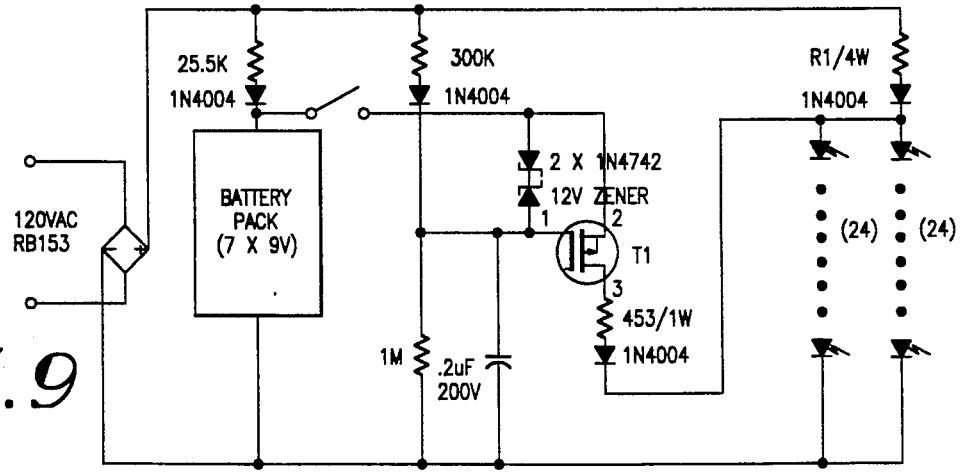
FIG. 9 is a schematic drawing showing a second specific example of the invention.

FIG. 9 shows the circuitry for another example embodiment without the flashing feature with each of the circuit elements selected as designated and electrically connected in FIG. 9.

EXAMPLES

Figure 8:
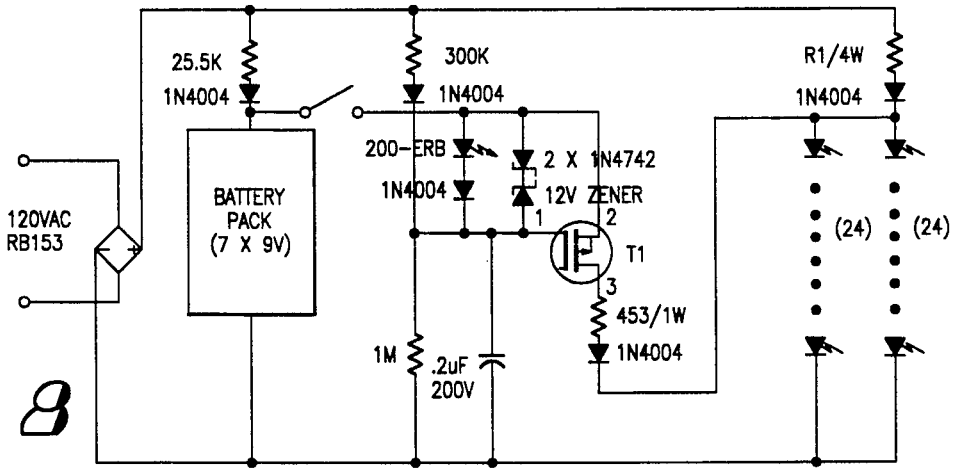
FIG. 8 is another schematic drawing showing a first specific example of the invention.

Two specific examples of signs having features of the inventions are illustrated diagrammatically in FIGS. 8 and 9.

Although the present invention has been described in considerable detail with reference to certain preferred versions, many other versions should be apparent to those skilled in the art. Therefore, the spirit and scope of the appended claims should not necessarily be limited to the description of the preferred versions contained therein.

What is claimed is:

1. An illuminating module which can be retrofitted into an existing incandescent light bulb socket having a female connector socket which is energized by an external source of electrical power, the module comprising:

(a) a planar baseboard having an upper baseboard surface and a parallel lower baseboard surface;

(b) a plurality of light emitting electrical units affixed to the upper baseboard surface or to both upper and lower baseboard surfaces, the light emitting electrical units being electrically interconnected in a desired pattern to form an array, the array having opposite electrical poles;

(c) an electrically conductive cylindrical base connector adapted to connect to the female connector socket, the base connector having oppositely charged electrical poles and being affixed to the baseboard, and wherein the base connector is rotatable about its longitudinal axis while the baseboard is kept stationary;

(d) means for electrically connecting the array with the oppositely charged poles of the female connector to form a closed circuit;

(e) battery means affixed to the baseboard for supplying electrical power to the array when the flow of external electrical power to the female connector is disrupted;

(f) recharging means for recharging the battery means from the source of external electrical power; and (g) automatic switching means for automatically switching the supply of electrical power for the array from the external source of electrical power to the battery means, when the flow of external electrical power is disrupted.

2. The module of claim 1 wherein the base connector is affixed to an edge of the baseboard with its longitudinal axis in the plane of the baseboard.

3. The module of claim 1 wherein the battery means are releasably affixed to the baseboard.

4. The module of claim 1 wherein the light emitting electrical units are light-emitting diodes.

5. The module of claim 1 comprising two cylindrical base connectors wherein the cylindrical base connectors are affixed to an edge of the baseboard with their longitudinal axes in parallel with, or transverse to, each other and in the plane of the baseboard, with the base connectors oriented appropriately and spaced apart sufficiently to connect into existing female connector sockets.

6. The module of claim 1 comprising three or more plurality of cylindrical base connectors wherein the cylindrical base connectors are affixed to an edge of the baseboard with their longitudinal axes in parallel with, or transverse to, each other and in the plane of the baseboard, with the base connectors oriented appropriately and spaced apart sufficiently to connect into existing female connector sockets.

7. The module of claim 1 further comprising a T-shaped member with an upper surface and a lower surface, the member transversely disposed across a notch defined in the baseboard, with the base connector rotatably mounted on the member, the member further comprising:

(a) an electrically conductive upper strip conductor affixed to the upper member surface, the upper strip conductor being electrically connected at its one end to a first of the two array electrical poles and at its other end in electrical contact with a first of the two base connector electrical poles; and (b) an electrically conductive lower strip conductor affixed to the lower member surface, the lower strip conductor being electrically connected at its one end to the second of the two array electrical poles and at its other end in electrical contact with a second of the two connector base electrical poles.

8. The module of claim 7 wherein the T-shaped member has an opening extending between the upper member surface and the lower member surface, and wherein the upper and lower conductive strips terminate at one end proximate to the corresponding member opening; the module further comprising:

(a) an electrically conductive shaft having an upper shaft end and a lower shaft end, the upper shaft end being adapted with a shaft head of greater diameter than that of the member opening, the shaft being slidably and rotatably disposed within the member opening, the lower shaft end being adapted with a downwardly directed electrical contact point;

(b) an electrically conductive cylindrical base connector having an upper base connector end with a diameter greater than that of the member opening and lower base connector end adapted to connect to the female connector socket, the connector being affixed around, and electrically insulated from, the lower shaft end such that the longitudinal axis of the base connector is substantially coincident with the longitudinal axis of the shaft;

(c) an electrically conductive coiled spring having an upper spring end with a diameter less than that of the shaft head and a lower spring end with a diameter greater than the member opening, the spring being slidably affixed around the upper shaft end such that the lower spring end impinges the upper strip conductor and the upper spring end impinges the underside of the shaft head, the spring being adapted to urge the upper base connector end against the lower strip conductor;

wherein the base connector can be rotated about its longitudinal axis by rotating the shaft using a thumb wheel concentrically affixed to the upper portion of the cylindrical base connector, and wherein electrical current can be caused to flow through the base connector to the lower strip conductor, through the lower strip conductor to the array of light-emitting electrical units, through the array of the light-emitting electrical units to the upper strip conductor, through the upper strip conductor to the coiled spring, through the coiled spring to the shaft, and through the shaft to the downwardly directed electrical contact point.

9. An illuminating module which can be retrofitted into an existing incandescent light bulb socket having two female connector sockets which are energized by an external source of electrical power, the module comprising:

(a) a planar baseboard having an upper baseboard surface and a parallel lower baseboard surface;

(b) a plurality of light emitting diodes affixed to the upper baseboard surface, or to both upper and lower baseboard surfaces, the light emitting diodes being electrically interconnected in a desired pattern to form an array, the array having opposite electrical poles;

(c) two T-shaped mounting members, each member transversely disposed across a corresponding notch defined in the baseboard, the notches spaced apart sufficient to match the spacing of the female connector sockets;

(d) two electrically conductive cylindrical base connectors adapted to connect to the female connector sockets, the base connectors having oppositely charged electrical poles and being rotatably mounted on the corresponding T-shaped members with their longitudinal axes in parallel to each other and to the plane of the baseboard, wherein the base connectors are rotatable about their longitudinal axes while the baseboard is kept stationary;

(e) means for electrically connecting the array with the oppositely charged poles of one of the female connectors to form a closed circuit;

(f) battery means affixed to the baseboard for supplying electrical power to the array when the flow of external electrical power to the female connectors is disrupted;

(g) recharging means for recharging the battery means from the source of external electrical power; and (h) automatic switching means for automatically switching the supply of electrical power for the array from the external source of electrical power to the battery means, when the flow of external electrical power is disrupted.

10. The module of claim 9 further comprising flashing means to cause the light-emitting diodes to turn on and off when the flow of external electrical power is disrupted.

11. The module of claim 9 wherein each T-shaped member further comprises:

(a) an electrically conductive upper strip conductor affixed to the upper member surface, the upper strip conductor being electrically connected at its one end to a first of the two array electrical poles and at its other end in electrical contact with a first of the two base connector electrical poles; and (b) an electrically conductive lower strip conductor affixed to the lower member surface, the lower strip conductor being electrically connected at its one end to the second of the two array electrical poles and at its other end in electrical contact with a second of the two connector base electrical poles.

12. The module of claim 11 wherein each T-shaped member has an opening extending between the upper member surface and the lower member surface, and wherein the upper and lower conductive strips terminate at one end proximate to the corresponding member opening; the module further comprising:

(a) an electrically conductive shaft having an upper shaft end and a lower shaft end, the upper shaft end being adapted with a shaft head of greater diameter than that of the member opening, the shaft being slidably and rotatably disposed within the member opening, the lower shaft end being adapted with a downwardly directed electrical contact point;

(b) an electrically conductive cylindrical base connector having an upper base connector end with a diameter greater than that of the member opening and lower base connector end adapted to connect to the female connector socket, the connector being affixed around, and electrically insulated from, the lower shaft end such that the longitudinal axis of the base connector is substantially coincident with the longitudinal axis of the shaft;

(c) an electrically conductive coiled spring having an upper spring end with a diameter less than that of the shaft head and a lower spring end with a diameter greater than the member opening, the spring being slidably affixed around the upper shaft end such that the lower spring end impinges the upper strip conductor and the upper spring end impinges the underside of the shaft head, the spring being adapted to urge the upper base connector end against the lower strip conductor;

wherein the base connector can be rotated about its longitudinal axis by rotating the shaft through a thumb wheel concentrically affixed to the upper portion of the cylindrical base connector, and wherein electrical current can be caused to flow through the base connector to the lower strip conductor, through the lower strip conductor to the array of light-emitting electrical units, through the array of the light-emitting electrical units to the upper strip conductor, through the upper strip conductor to the coiled spring, through the coiled spring to the shaft, and through the shaft to the downwardly directed electrical contact point.

13. The module of claim 11 wherein the battery means are releasably affixed to the baseboard.

14. An illuminating module which can be retrofitted into an existing incandescent light bulb socket having two female connector sockets which are energized by an external source of electrical power, the module comprising:

(a) a planar baseboard having an upper baseboard surface and a parallel lower baseboard surface;

(b) a plurality of light-emitting diodes affixed to the upper member surface, or to upper and lower member surfaces, the light emitting diodes being electrically interconnected in a desired pattern to form an array, the array having opposite electrical poles;

(c) a first T-shaped mounting member with an upper surface and a lower surface, the member transversely disposed across a first notch defined in the baseboard, the member having an opening extending between the upper member surface and the lower member surface;

(d) an electrically conductive upper strip conductor affixed to the upper member surface, the upper strip conductor being electrically connected at its one end to a first of the two array electrical poles and terminating at its other end proximate to the member opening;

(e) an electrically conductive lower strip conductor affixed to the lower member surface, the lower strip conductor being electrically connected at its one end to the second of the two array electrical poles and terminating at its other end proximate to the member opening;

(f) an electrically conductive shaft having an upper shaft end and a lower shaft end, the upper shaft end being adapted with a shaft head of greater diameter than that of the member opening, the shaft being slidably and rotatably disposed within the member opening, the lower shaft end being adapted with a downwardly directed electrical contact point;

(g) an electrically conductive cylindrical base connector having an upper base connector end with a diameter greater than that of the member opening and lower base connector end adapted to connect to a corresponding female connector socket, the connector being affixed around, and electrically insulated from, the lower shaft end such that the longitudinal axis of the base connector is substantially coincident with the longitudinal axis of the shaft;

(h) an electrically conductive coiled spring having an upper spring end with a diameter less than that of the shaft head and a lower spring end with a diameter greater than the member opening, the spring being slidably affixed around the upper shaft end such that the lower spring end impinges the upper strip conductor and the upper spring end impinges the underside of the shaft head, the spring being adapted to urge the upper base connector end against the lower strip conductor;

wherein the base connector can be rotated about its longitudinal axis by rotating the shaft through a thumb wheel concentrically affixed to the upper portion of the cylindrical base connector, and wherein electrical current can be caused to flow through the base connector to the lower strip conductor, through the lower strip conductor to the array of light emitting diodes, through the array of the light emitting diodes to the upper strip conductor, through the upper strip conductor to the coiled spring, through the coiled spring to the shaft, and through the shaft to the downwardly directed electrical contact point;

(i) a second T-shaped mounting member with an upper surface and a lower surface, the member transversely disposed across a second notch defined in the baseboard spaced apart from the first notch sufficient to match the spacing of the female connector sockets, the member having an opening extending between the upper member surface and the lower member surface;

(j) a shaft having an upper shaft end and a lower shaft end, the upper shaft end being adapted with a shaft head of greater diameter than that of the member opening, the shaft being slidably and rotatably disposed within the member opening, the lower shaft end being adapted with a downwardly directed electrical contact point;

(k) a second electrically conductive cylindrical base connector having an upper base connector end with a diameter greater than that of the member opening and lower base connector end adapted to connect to a corresponding female connector socket, the connector being affixed around, and electrically insulated from, the lower shaft end such that the longitudinal axis of the base connector is substantially coincident with the longitudinal axis of the shaft;

wherein the first and second base connectors are spaced apart sufficient to connect into the female sockets;

(l) a coiled spring having an upper spring end with a diameter less than that of the shaft head and a lower spring end with a diameter greater than the member opening, the spring being slidably affixed around the upper shaft end such that the lower spring end impinges the upper strip conductor and the upper spring end impinges the underside of the shaft head, the spring being adapted to urge the upper base connector end against the lower strip conductor;

wherein the base connector can be rotated about its longitudinal axis by rotating the shaft through a thumb wheel concentrically affixed to the upper portion of the cylindrical base connector;

(m) battery means releasably affixed to the baseboard for supplying electrical power to the array when the flow of external electrical power to the female connectors is disrupted;

(n) recharging means for recharging the battery means from the source of external electrical power; and (o) automatic switching means for automatically switching the supply of electrical power for the array from the external source of electrical power to the battery means, when the flow of external electrical power is disrupted.

15. The module of claim 14 wherein each base connector is adapted for threaded projection into a depending female connector socket.

16. The module of claim 14 wherein each base connectors is adapted for projection into a corresponding female connector socket having two or more connection grooves, the base connector having an equivalent number of projections adapted to cooperate with, and interlock within, the connection grooves.

17. The module of claim 14 further comprising flashing means to cause the light-emitting diodes to turn on and off when the flow of external electrical power is disrupted.

* * * * *